US005339847A

United States Patent [19]

Kanter et al.

[11] Patent Number: 5,339,847

[45] Date of Patent: Aug. 23, 1994

[54] BEACH UMBRELLA

[76] Inventors: David J. Kanter, 5699 Torrey Pine Ct., Richmond, Calif. 94803; Milo F. Basker, Jr., 1461 Dewing La., Walnut Creek, Calif. 94595

[21] Appl. No.: 161,585

[22] Filed: Dec. 6, 1993

[51] Int. Cl.[5] ..... A45B 11/00

[52] U.S. Cl. ..... 135/16; 135/20.1; 248/533; 52/152

[58] Field of Search ..... 135/16, 19, 19.5, 20.1; 248/533, 530, 548, 545; 52/152, 153, 162

[56] References Cited

U.S. PATENT DOCUMENTS

| | | | |
|---|---|---|---|
| 2,764,993 | 10/1956 | Wallace et al. | 135/20.1 X |
| 2,871,868 | 2/1959 | Faasse et al. | 135/20.1 X |
| 3,429,320 | 2/1969 | Edelkind | 135/20.1 |
| 4,296,693 | 10/1981 | Archer . | |
| 4,624,275 | 11/1986 | Baldwin | 135/20.1 X |
| 4,753,411 | 6/1988 | Lechner et al. . | |
| 4,832,304 | 5/1989 | Morgulis | 135/16 X |
| 4,924,893 | 5/1990 | Furey . | |
| 5,088,681 | 2/1992 | Procaccianti et al. . | |
| 5,156,369 | 10/1992 | Tizzoni . | |
| 5,293,889 | 3/1994 | Hall et al. | 135/16 |

FOREIGN PATENT DOCUMENTS

| | | | |
|---|---|---|---|
| 0312675 | 4/1989 | European Pat. Off. | 135/16 |
| 2050339 | 5/1971 | Fed. Rep. of Germany | 135/16 |

*Primary Examiner*—Carl D. Friedman
*Assistant Examiner*—Lan C. Mai
*Attorney, Agent, or Firm*—Michael J. Colitz, Jr.

[57] ABSTRACT

A new and improved beach umbrella with increased stability and wind resistance comprising an umbrella fabric having a top surface and a bottom surface, a fabric loop integral with the bottom of each of the four corners of the fabric umbrella; an umbrella support having a lower vertical extent, the lower vertical extent having an upper portion and a lower portion, the umbrella support further having an upper horizontal extent, the upper horizontal extent having a forward portion and a rearward portion, a first arm pivotally connected to the horizontal extent intermediate the forward and rearward portions, a second arm pivotally connected to the horizontal extent opposite the first arm with the forward portion of the horizontal extent, the rearward portion of the horizontal extent, the end of the first arm and the end of the second arm all adapted to be received within one of the fabric loops of the umbrella; a hollow spike having an upper opened portion and a lower closed pointed portion, the pointed portion adapted to be inserted into the ground, the hollow spike adapted to receive the lower portion of the lower vertical extent of the umbrella support; a tubular collar having an inner surface and an outer surface, the tubular collar adapted to receive and slide upon the hollow spike; and horizontal bracing poles each pole having a first pole component telescoping received within a second pole component, each of the bracing poles being pivotally connected to the tubular collar.

4 Claims, 4 Drawing Sheets

BEACH UMBRELLA

BACKGROUND OF THE INVENTION

Field of the Invention

The present invention relates to a beach umbrella and more particularly, pertains to a beach umbrella with increased stability and wind resistance.

Description of the Prior Art

The use of beach umbrellas is known in the prior art. More specifically, beach umbrellas are known to consist basically of familiar, expected and obvious structural configurations, notwithstanding the myriad of designs encompassed by the crowded prior art which have been developed for the fulfillment of countless objectives and requirements.

For example, U.S. Pat. No. 4,924,893 discloses a beach umbrella safety system. The system includes an anchor member comprising a container in the form of a beach bag for containing a weighing medium such as sand.

U.S. Pat. No. 5,088,681 discloses an anchor device for the use on the stake of a beach umbrella. The anchor device includes a flight that extends helically around the main body.

U.S. Pat. No. 4,296,693 discloses a beach umbrella support. The support is formed by a collapsible container which can be filled with solid or liquid material to give it stability.

U.S. Pat. No. 5,156,369 discloses a ground anchoring arrangement for attachment to the pole of a beach umbrella. The arrangement includes a spiral screw which is attached to one end of the rod, while the other end of the rod is attachable to a handle rotator.

Yet another example is U.S. Pat. No. 4,753,411 which discloses a beach umbrella safety base. The base includes a collar which is inserted over the staff of a beach umbrella and has four pivotable struts.

While these beach umbrellas fulfill their respective, particular objectives and requirements, the aforementioned patents do not describe a beach umbrella which provides increased stability and wind resistance.

In this respect, the beach umbrella according to the present invention substantially departs from the conventional concepts and designs of the prior art, and in so doing provides an umbrella specifically designed to be stable and wind resistant.

SUMMARY OF THE INVENTION

In view of the foregoing disadvantages inherent in the known types of beach umbrellas now present in the prior art, the present invention provides an improved beach umbrella. As such, the general purpose of the present invention, which will be described subsequently in greater detail, is to provide a new and improved beach umbrella and method which has all the advantages of the prior art and none of the disadvantages.

To attain this, the present invention essentially comprises a beach umbrella with increased stability and wind resistance comprising, in combination, a rectangular umbrella fabric having a top surface and a bottom surface, a fabric loop integral with the bottom of each of the four corners of the fabric umbrella; an umbrella support having a lower vertical extent, the lower vertical extent having an upper portion and a lower portion, the umbrella support further having an upper horizontal extent, the upper horizontal extent having a forward portion and a rearward portion, a first arm pivotally connected to the horizontal extent intermediate the forward and rearward portions, a second arm pivotally connected to the horizontal extent opposite the first arm with the forward portion of the horizontal extent, the rearward portion of the horizontal extent, the end of the first arm and the end of the second arm all adapted to be received within one of the fabric loops of the fabric umbrella and a male detent element positioned upon the lower vertical extent intermediate the upper and lower portions; a hollow spike having an upper opened portion and a lower closed pointed portion, the pointed portion adapted to be inserted into the ground, a plurality of aligned female detent elements positioned through the spike intermediate the upper and lower portions, the hollow spike adapted to receive the lower portion of the lower vertical extent of the umbrella support such that the male detent element selectively cooperates with one of the female detent elements; a tubular collar having an inner surface and an outer surface, and two rectangular apertures formed through the tubular collar, the tubular collar adapted to receive and slide upon the hollow spike; and horizontal bracing poles, each pole having a first pole component telescoping received within a second pole component, each of the bracing poles being pivotally connected to the tubular collar adjacent one of the rectangular apertures, the pivoting of each of the bracing poles being such that when the bracing pole is pivoted perpendicular to the collar the portion of the bracing pole adjacent to the rectangular aperture extends into rectangular aperture, thus when the spike is received within the collar and the horizontal bracing poles are pivoted perpendicular to the collar the ends of the bracing poles positively engage the spike.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved beach umbrella which has all the advantages of the prior art beach umbrellas and none of the disadvantages.

It is another object of the present invention to provide a new and improved beach umbrella which may be easily and efficiently manufactured and marketed.

It is a further object of the present invention to provide a new and improved beach umbrella which is of a durable and reliable construction.

An even further object of the present invention is to provide a new and improved beach umbrella which is susceptible of a low cost of manufacture with regard to both materials and labor, and which accordingly is then susceptible of low prices of sale to the consuming public, thereby making such beach umbrellas economically available to the buying public.

Still yet another object of the present invention is to provide a new and improved beach umbrella which provides in the apparatuses and methods of the prior art some of the advantages thereof, while simultaneously overcoming some of the disadvantages normally associated therewith.

Still another object of the present invention is to provide a new and improved beach umbrella which has increased stability.

Yet another object of the present invention is to provide a new and improved beach umbrella which has increased wind resistance.

Even still another object of the present invention is to provide a new and improved beach umbrella comprising a new and improved beach umbrella with increased stability and wind resistance comprising, an umbrella fabric having a top surface and a bottom surface, a fabric loop integral with the bottom of each of the four corners of the fabric umbrella; an umbrella support having a lower vertical extent, the lower vertical extent having an upper portion and a lower portion, the umbrella support further having an upper horizontal extent, the upper horizontal extent having a forward portion and a rearward portion, a first arm pivotally connected to the horizontal extent intermediate the forward and rearward portions, a second arm pivotally connected to the horizontal extent opposite the first arm with the forward portion of the horizontal extent, the rearward portion of the horizontal extent, the end of the first arm and the end of the second arm all adapted to be received within one of the fabric loops of the umbrella; a hollow spike having an upper opened portion and a lower closed pointed portion, the pointed portion adapted to be inserted into the ground, the hollow spike adapted to receive the lower portion of the lower vertical extent of the umbrella support; a tubular collar having an inner surface and an outer surface, the tubular collar adapted to receive and slide upon the hollow spike; and horizontal bracing poles each pole having a first pole component telescoping received within a second pole component, each of the bracing poles being pivotally connected to the tubular collar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
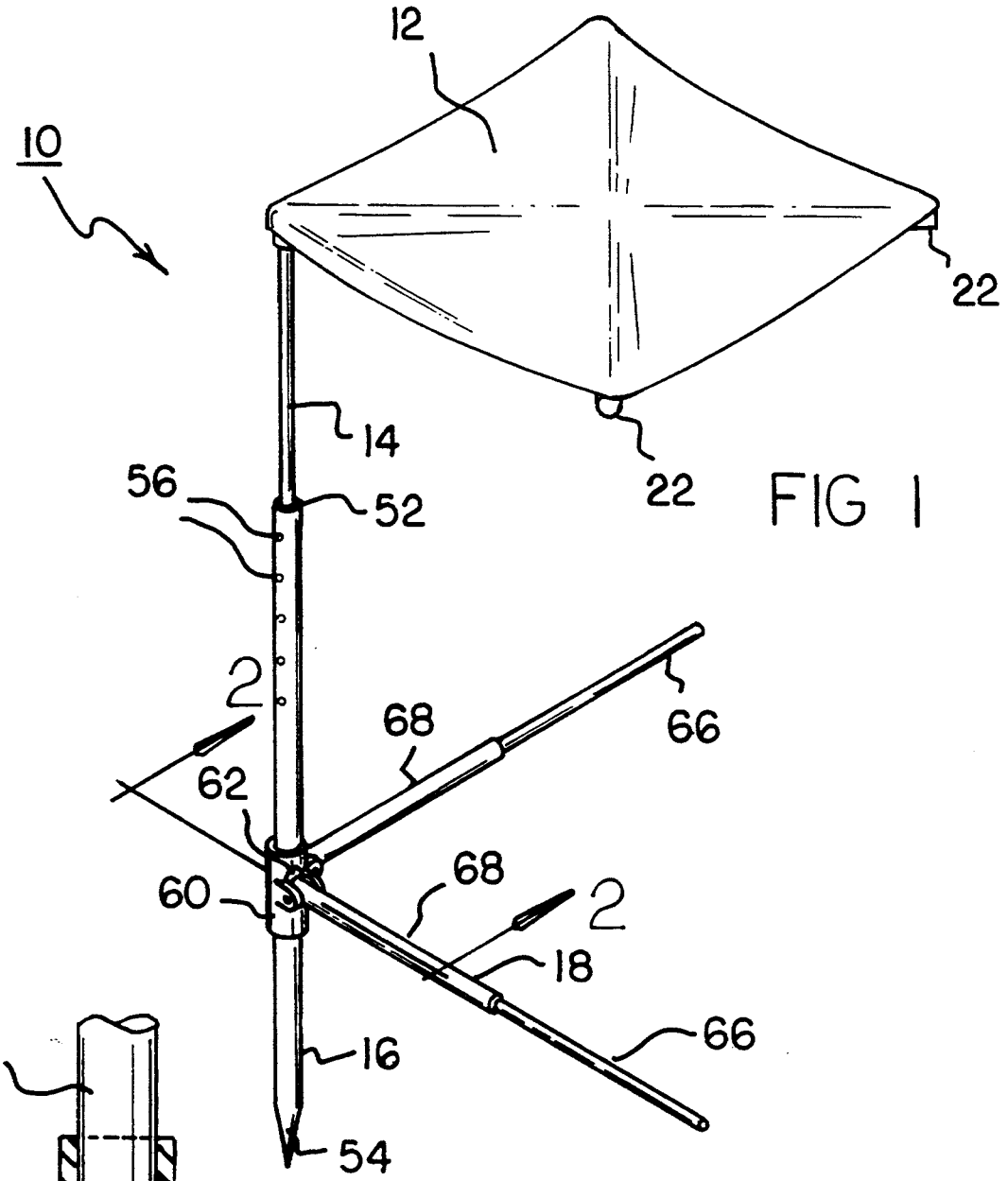
FIG. 1 is a perspective view of a beach umbrella constructed in accordance with the first embodiment of the invention.

With reference now to the drawings, and in particular to FIG. 1 thereof, a new and improved beach umbrella embodying the principles and concepts of the present invention and generally designated by the reference numeral 10 will be described.

More specifically, it will be noted that the new and improved beach umbrella 10 is designed for increased stability and wind resistance. The umbrella 12 of the present invention includes an umbrella fabric 12, an umbrella support 14, a spike 16 and horizontal bracing poles 18.

The rectangular umbrella fabrication includes a top surface and a bottom surface. The fabric umbrella further includes a fabric loop 22 and 24 integral with the bottom of each of its four corners. The loops are for use in securing the umbrella fabric 12 to the umbrella support 14 as will be described hereafter. In order to facilitate the placement of the umbrella upon the umbrella support, one of the fabric loops employs a pile type fastener 26 to enable the loop to be secured about a support arm without a free end.

The umbrella support 14 includes a lower vertical extent 28 with an upper portion 30 and a lower portion 32. The umbrella support 14 includes a lower portion 32. The umbrella support 14 further includes an upper horizontal extent 36 with a forward portion 38 and a rearward portion 40. A first arm 42 is pivotally connected to the horizontal extent 36 intermediate the forward and rearward portions, and a second arm 44 is pivotally connected to the horizontal extent opposite the first arm.

The first and second arms are pivotally secured to a bracket 46. The bracket 46 is secured to the center of the horizontal extent 36 whereby the opposite halves of the horizontal extent extending in an x-shaped support for the umbrella fabric 12.

In order to secure the fabric umbrella to the umbrella support, the forward portion of the horizontal extent, the rearward portion of the horizontal extent, the end of the first arm and the end of the second arm are all adapted to be received within one of the fabric loops 22 and 24 of the fabric umbrella. Three of the loops 22 are formed as rigid tubes. As previously described, one of the fabric loops 24 employs pile type fastener in a belt configuration in order to permit its placement about the rearward end of the horizontal extent of the umbrella support. Furthermore, a spring biased male detent element 48 is positioned within, to extend outwardly from, the vertical extent intermediate the upper and lower portions. The use of the male detent element will be described hereafter.

The hollow spike 16 includes an upper opened portion 52 and a lower closed portion forming a spike 54. The pointed portion of the spike 54 as well as the spike itself, is adapted to be inserted into the ground. The spike further includes a plurality of aligned female detent holes 56 positioned through the spike intermediate the upper and lower portions. The hollow spike is adapted to receive the lower portion of the lower vertical extent 28 of the umbrella support 14. The spike receives the umbrella support in a telescopic manner such that the male detent element 48 of the support selectively cooperates with one of the female detent holes 56 of the spike.

A tubular collar 60 which has an inner surface and an outer surface is designed for cooperation with the hollow spike. The tubular collar 60 includes two apertures 62 formed through its surface. The apertures 62 are formed at locations perpendicular to one another about the periphery of the collar. The tubular collar is sized to receive and slide upon the hollow spike.

Figure 2:
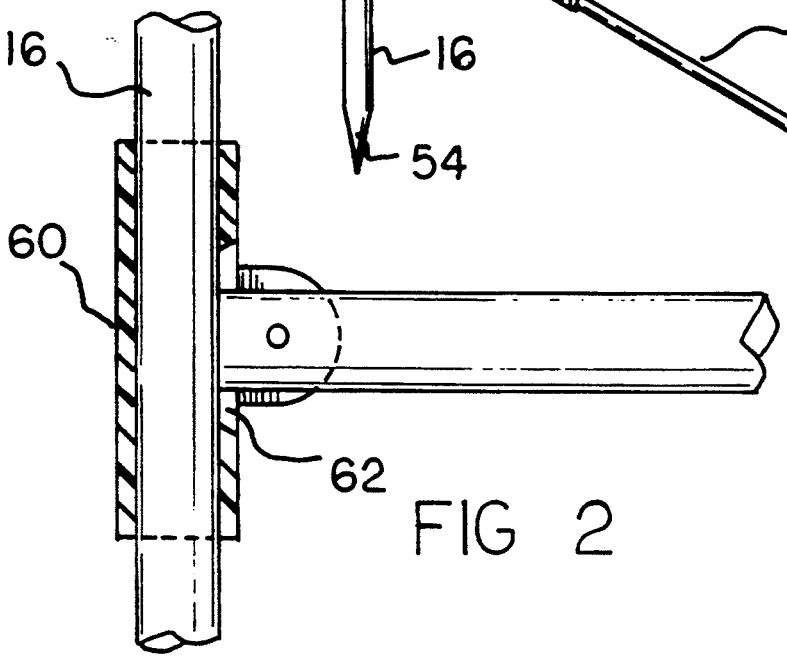
FIG. 2 is a sectional view taken along line 2—2 of FIG. 1.
Figure 3:
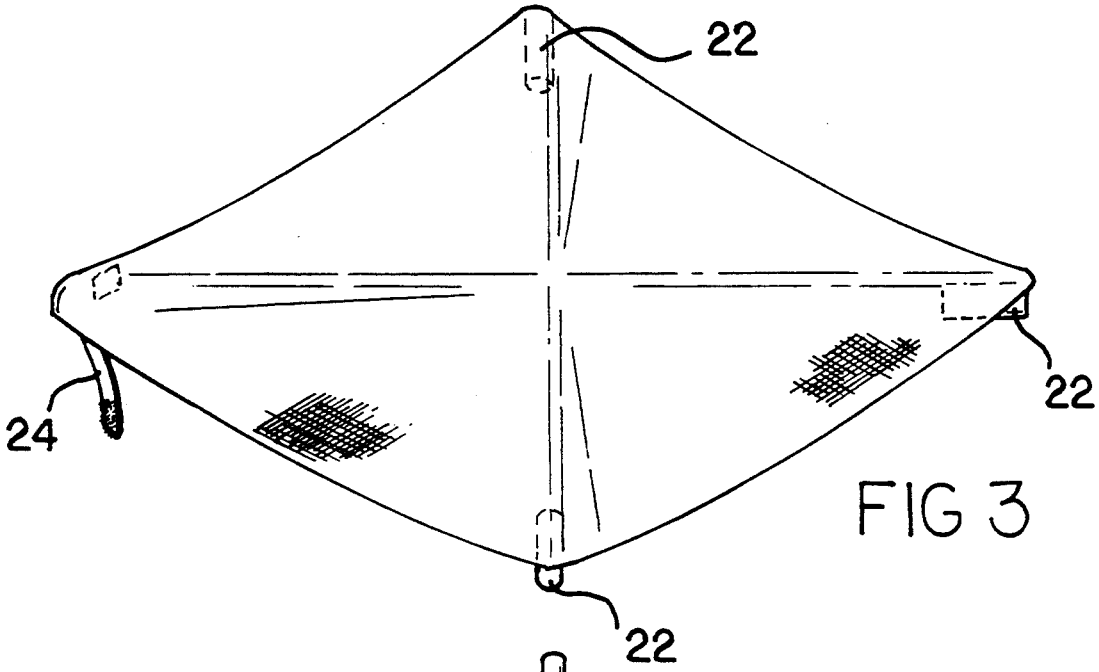
FIG. 3 is a perspective view of the umbrella support constructed in accordance with the present invention.
Figure 4:
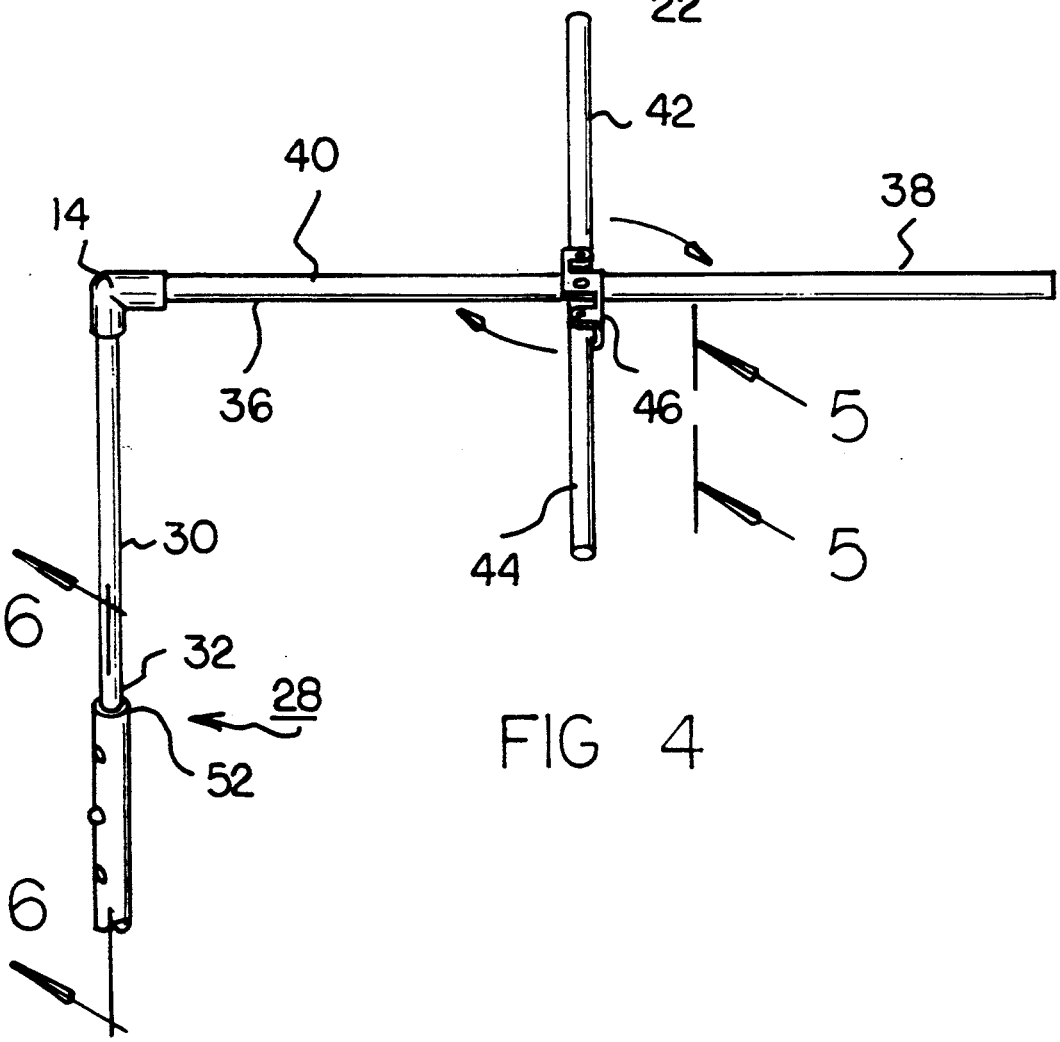
FIG. 4 is a perspective view of the umbrella support in accordance with the present invention.
Figure 5:
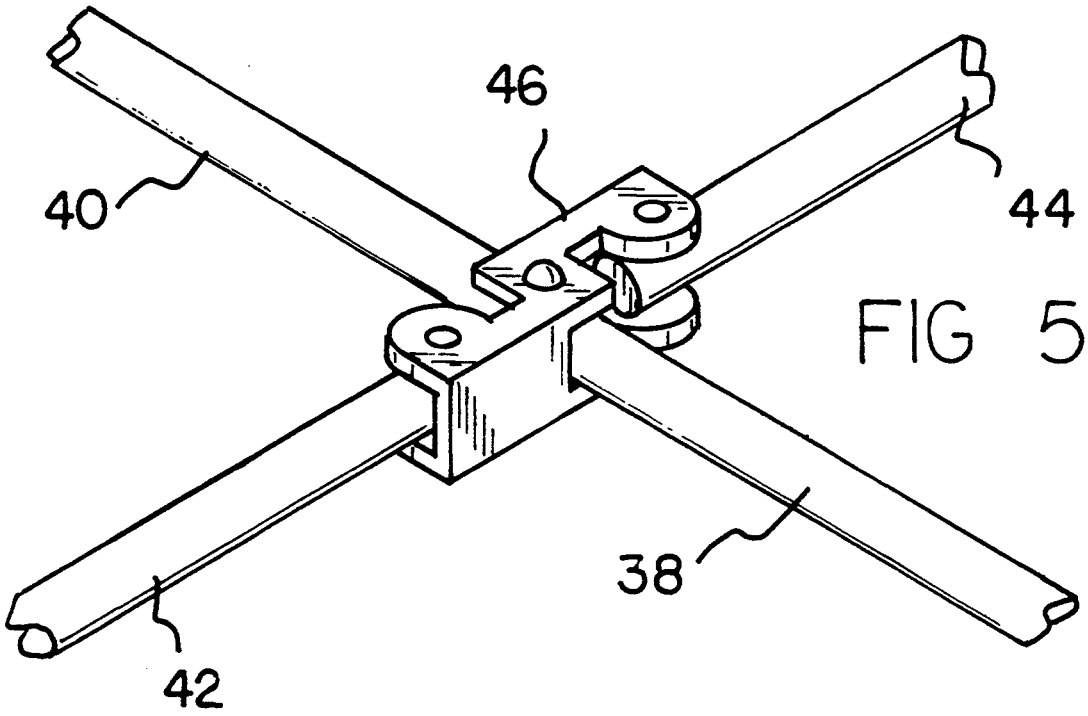
FIG. 5 is a sectional view taken along line 5—5 of FIG. 4.
Figure 6:
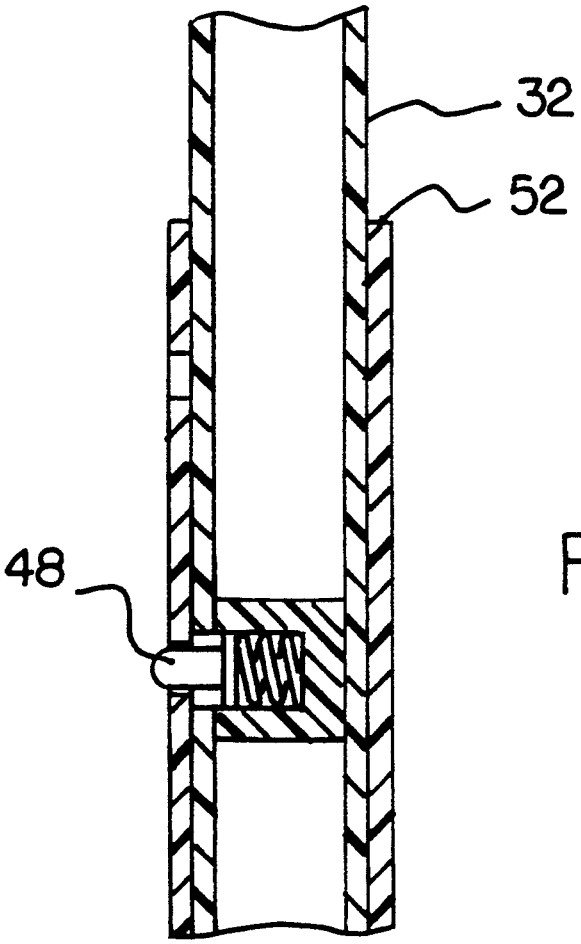
FIG. 6 is a sectional view of the detent element constructed in accordance with the present invention.
Figure 7:
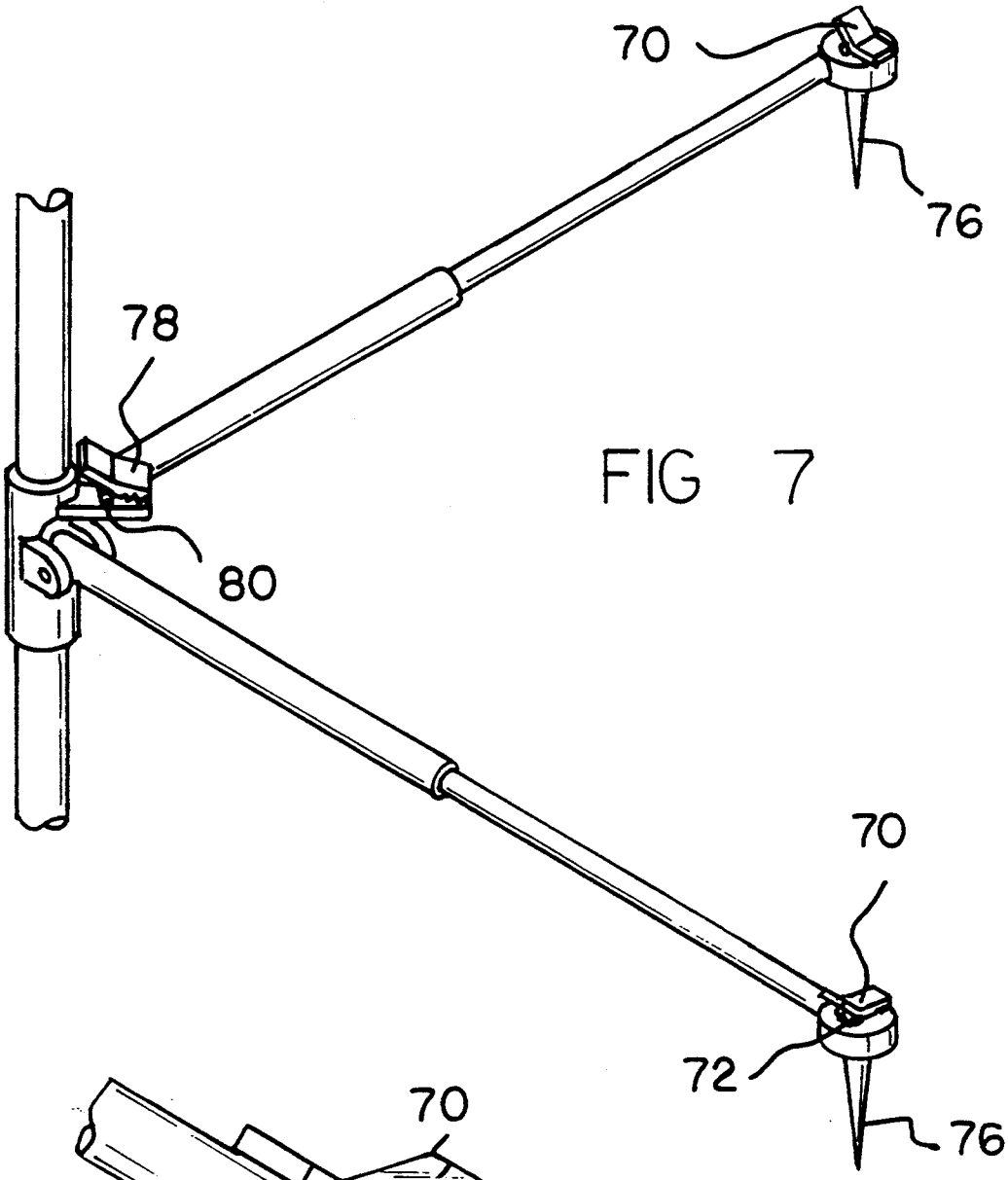
FIG. 7 is a perspective view of the horizontal bracing poles constructed in accordance with the second embodiment of the present invention.
Figure 8:
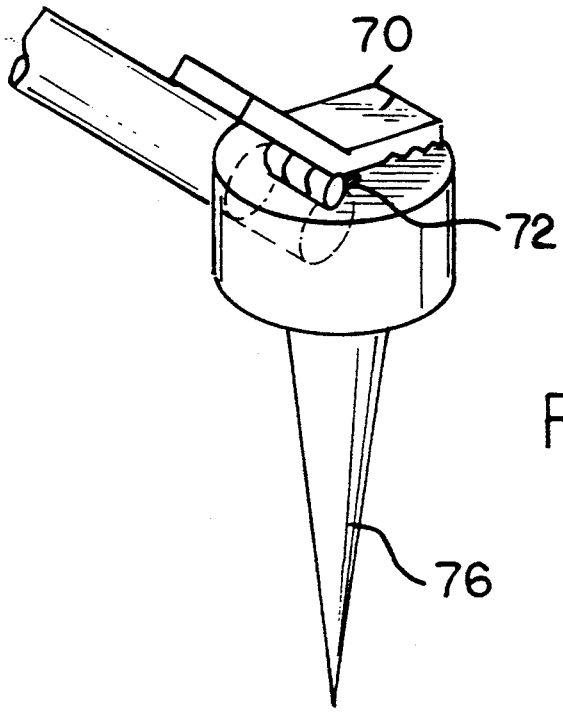
FIG. 8 is an enlarged perspective view of the spring biased towel clip constructed in accordance with the second embodiment of the present invention.

Two horizontal bracing poles 18 are pivotally coupled with the tubular collar. Each of the horizontal bracing poles 18 has a first pole component 66 telescoping received within a second pole component 68. Furthermore, each of the bracing poles 18 is pivotally connected to the tubular collar adjacent to one of the two rectangular apertures 62 in the collar. The pivoting of each of the bracing poles 18 is such that when either bracing pole 18 is pivoted perpendicular to the collar as shown in FIG. 2, the portion of the bracing pole 18 adjacent to the aperture extends into the aperture 62. Thus, when the spike is received within the collar, with the horizontal bracing poles pivoted perpendicular to the collar, the ends of the bracing poles thereadjacent positively engage the spike. This arrangement serves to positively lock the spike relative to the collar and the bracing poles relative to the collar. Pivoting of the bracing poles may only be done when the collar is removed from the spike.

In use, the hollow spike, with telescoping received umbrella support 14 is inserted into the ground. The first and second arms 42 and 44 are pivoted such that they are perpendicular to the horizontal extent 36 of the umbrella support 14. The umbrella fabric 12 is then secured to the support by placing the ends of the first and second arms, and the forward portion of the horizontal extent into the tubular fabric loops of the umbrella fabric. Furthermore, the second embodiment includes a large towel clip 78 and spring 80 positioned upon the outer surface of the tubular collar in between the two horizontal bracing poles 68.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A beach umbrella with increased stability and wind resistance comprising, in combination:

a rectangular umbrella fabric having a top surface and a bottom surface, a fabric loop integral with the bottom of each of the four corners of the fabric umbrella;

an umbrella support having a lower vertical extent, the lower vertical extent having an upper portion and a lower portion, the umbrella support further having an upper horizontal extent, the upper horizontal extent having a forward portion and a rearward portion, a first arm pivotally connected to the horizontal extent intermediate the forward and rearward portions, a second arm pivotally connected to the horizontal extent opposite the first arm with the forward portion of the horizontal extent, the rearward portion of the horizontal extent, the end of the first arm and the end of the second arm all adapted to be received within one of the fabric loops of the fabric umbrella and a male detent element positioned upon the lower vertical extent intermediate the upper and lower portions;

a hollow spike having an upper opened portion and a lower closed pointed portion, the pointed portion adapted to be inserted into the ground, a plurality of aligned female detent elements positioned through the spike intermediate the upper and lower portions, the hollow spike adapted to receive the lower portion of the lower vertical extent of the umbrella support such that the male detent element selectively cooperates with one of the female detent elements;

a tubular collar having an inner surface and an outer surface, and two rectangular apertures formed through the tubular collar, the tubular collar adapted to receive and slide upon the hollow spike; and horizontal bracing poles, each pole having a first pole component telescoping received within a second pole component, each of the bracing poles being pivotally connected to the tubular collar adjacent one of the rectangular apertures, the pivoting of each of the bracing poles being such that when the bracing pole is pivoted perpendicular to the collar then the portion of the bracing pole adjacent to the rectangular aperture extends into the rectangular aperture, thus when the spike is received within the collar and the horizontal bracing poles are pivoted perpendicular to the collar then the ends of the bracing poles positively engage the spike.

2. A beach umbrella with increased stability and wind resistance comprising:

an umbrella fabric having a top surface and a bottom surface, a fabric loop integral with the bottom of each of the four corners of the fabric umbrella;

an umbrella support having a lower vertical extent, the lower vertical extent having an upper portion and a lower portion, the umbrella support further having an upper horizontal extent, the upper horizontal extent having a forward portion and a rearward portion, a first arm pivotally connected to the horizontal extent intermediate the forward and rearward portions, a second arm pivotally connected to the horizontal extent opposite the first arm with the forward portion of the horizontal extent, the rearward portion of the horizontal extent, the end of the first arm and the end of the second arm all adapted to be received within one of the fabric loops of the umbrella;

a hollow spike having an upper opened portion and a lower closed pointed portion, the pointed portion adapted to be inserted into the ground, the hollow spike adapted to receive the lower portion of the lower vertical extent of the umbrella support;

a tubular collar having an inner surface and an outer surface, the tubular collar adapted to receive and slide upon the hollow spike; and horizontal bracing poles, each pole having a first pole component telescoping received within a second pole component, each of the bracing poles being pivotally connected to the tubular collar.

3. The beach umbrella of claim 2 and further including apertures in the collar adjacent to the regions where the bracing poles are pivotally coupled thereto adapted to allow the adjacent ends of the bracing poles to contact the spike to preclude the collar from sliding with respect to the spike and to preclude the brace poles from pivoting with respect to the collar.

4. The beach umbrella of claim 2 and further comprising:

a spring biased towel clip positioned at the end of the first pole component of each of the horizontal bracing poles;

a spike positioned beneath the spring biased towel clip of each of the horizontal bracing poles, the spike adapted to be inserted into the ground;

a large spring biased towel clip positioned upon the outer surface of the tubular collar in between the two horizontal bracing poles.

* * * * *